US007503262B2

(12) United States Patent
Eches et al.

(10) Patent No.: US 7,503,262 B2
(45) Date of Patent: Mar. 17, 2009

(54) SEALING BAND FOR PROJECTILE, SUB-CALIBER PROJECTILE AND AMMUNITION EQUIPPED WITH SUCH A BAND

(75) Inventors: Nicolas Eches, Plaimpied Givaudins (FR); Jean-Paul Fauchon, La Chapelle Saint Ursin (FR)

(73) Assignee: Giat Industries, Versailles (FR)

( * ) Notice: Subject to any disclaimer, the term of this patent is extended or adjusted under 35 U.S.C. 154(b) by 43 days.

(21) Appl. No.: 10/522,414

(22) PCT Filed: Jun. 24, 2003

(86) PCT No.: PCT/FR03/01941

§ 371 (c)(1),
(2), (4) Date: Jan. 26, 2005

(87) PCT Pub. No.: WO2004/017015

PCT Pub. Date: Feb. 26, 2004

(65) Prior Publication Data

US 2006/0032394 A1 Feb. 16, 2006

(30) Foreign Application Priority Data

Jul. 26, 2002 (FR) ..... 02 09505

(51) Int. Cl.
*F42B 14/06* (2006.01)

(52) U.S. Cl. ..... 102/521; 102/525; 102/524

(58) Field of Classification Search ..... 102/521, 102/523, 524–528; 89/1.4, 1.14
See application file for complete search history.

(56) References Cited

U.S. PATENT DOCUMENTS

| | | | | | |
|---|---|---|---|---|---|
| 3,738,279 | A | * | 6/1973 | Eyre et al. | 102/521 |
| 4,187,783 | A | * | 2/1980 | Campoli et al. | 102/520 |
| 4,444,113 | A | | 4/1984 | Campioli | 102/430 |
| 4,487,131 | A | * | 12/1984 | Luther | 102/523 |
| 4,747,191 | A | * | 5/1988 | Montier et al. | 86/52 |
| 4,833,995 | A | * | 5/1989 | Gotz et al. | 102/521 |
| 5,189,254 | A | * | 2/1993 | Berville et al. | 102/521 |
| 5,359,938 | A | | 11/1994 | Campioli et al. | 102/521 |
| 6,712,005 | B2 | * | 3/2004 | Heitmann | 102/439 |
| 2004/0244631 | A1 | * | 12/2004 | Eches et al. | 102/521 |
| 2005/0188891 | A1 | * | 9/2005 | Heitmann et al. | 102/523 |
| 2006/0032394 | A1 | * | 2/2006 | Eches et al. | 102/521 |

FOREIGN PATENT DOCUMENTS

| | | | |
|---|---|---|---|
| EP | 0 307 307 | | 7/1992 |
| EP | 1103780 | A1 * | 5/2001 |
| FR | 2842896 | * | 1/2004 |
| GB | 2241308 | | 8/1991 |

* cited by examiner

*Primary Examiner*—Michelle Clement
(74) *Attorney, Agent, or Firm*—Steptoe & Johnson LLP

(57) ABSTRACT

Sealing band for a projectile, the band being characterized in that it comprises a front sub-band containing at least two sectors, the sub-band having at least a conical profile in a tight fit with the matching profile of a groove of the projectile, the cone tip being placed towards a rear section of the projectile, with the sub-band attached to the projectile by a cylindrical skirt.

18 Claims, 7 Drawing Sheets

SEALING BAND FOR PROJECTILE, SUB-CALIBER PROJECTILE AND AMMUNITION EQUIPPED WITH SUCH A BAND

BACKGROUND OF THE INVENTION

1. Field of the Invention

The technical field of this invention is that of sealing bands for projectiles and especially for sub-caliber projectiles.

2. Description of the Related Art

Projectile bands have as an objective to provide during firing a seal to propellant gases between the wall of the barrel of the weapon and the projectile. These bands are usually placed in a surrounding groove of the projectile and, to provide such a seal, they are always slightly over-caliber (by approximately 10%).

A first problem encountered with known bands is to ensure the effectiveness of the seal during firing in worn barrels. Over-calibrating is not always sufficient to avoid leaks from surrounding gases, which reduce the projectile velocity, adversely affecting its efficiency and accelerating the wear of the barrel.

Attempts are in fact made to develop sub-caliber projectiles with ever increasing performance characteristics, i.e. with the greatest initial velocity possible (today this velocity is of the order of 1,800 m/s). Several types of bands have been developed for such sub-caliber projectiles.

According to established practice, sub-caliber projectiles consist of a sub-caliber (penetrator) core held by caliber sabot. The sabot is made of several segments (generally three) and releases the core upon exiting the weapon's barrel. The sabot usually has a sealing band positioned in a groove located on one section of the caliber sabot, a section usually called "pusher plate" since it is there that the propellant gases exert pressure.

European Patent EP307307 describes therefore a sealing band comprising a rear skirt attached to the cartridge casing, which provides during firing a low-pressure seal (pressure of the order of a few mega Pascal) and a front flange positioned in a groove of the projectile to ensure, like a classical sealing band, a high-pressure seal (pressure of the order of several hundreds of mega Pascal).

A low-pressure seal is essential in the first tens of milliseconds following ignition of the propellant charge contained in the combustible cartridge casing Indeed, the confinement provided by such a cartridge is inferior to that obtained with a metallic cartridge, and displacement of the projectile occurs at lower pressure. A seal that is not sufficiently sensitive to be operational from the time of ignition could have the risk of gases leaking through to the front of the projectile, which would decrease the efficiency of the propellant charge.

Such a device offers, however, some disadvantages.

The cartridge casing is fixed at the level of the skirt integral to the band, generally by riveting.

Rupture of the skirt during the passage of the weapon's forcing cone causes a decrease in the efficient width of the band. This results in a decrease in the firing ability of the projectile in worn barrels.

Furthermore, all efforts and mechanical constraints handled by the ammunition are transferred to the band, the sealing characteristics of which are at risk to deteriorate, which in turn could lead to dispersions from a ballistic point of view.

In order to further increase the velocity of projectiles, so-called "tractor" sabots have been developed, namely those wherein the pusher plate is located toward the front of the projectile.

The published document US-H-1353 describes such a projectile, which offers the advantage of a lightened sabot allowing for greater propellant powder charges in the cartridge.

However such a projectile should be fitted inside the barrel of the weapon, which compels the band to have a diameter inferior to the caliber to be fitted. Such an arrangement is detrimental to the sealing property due to a sub-caliber band. If on the contrary, an over-caliber band is used, it becomes difficult, or impossible to position the projectile due to induced friction.

Also, the guiding of such projectiles in the barrel is difficult to secure, and it is most often necessary to use ribs with a caliber extending to the back of the pusher plate. Such ribs hinder the sealing band assembly, which is most often fitted by hot deformation.

SUMMARY OF THE INVENTION

It is the purpose of this invention to provide a sealing band, which does not present such drawbacks.

In this way, the band according to the invention allows for a good quality seal even inside worn barrels, whilst being easy to fit on the projectile.

The band, according to the invention, also allows for the assembly of sub-caliber projectiles of the tractor type, thus with a light sabot, whilst ensuring, however, an excellent level of sealing without creating difficulties in terms of the positioning of the projectile.

The object of this invention is therefore a sealing band for a projectile, the band being characterized in that it comprises a front sub-band containing at least two sectors, the sub-band having at least a conical profile in a tight fit with the matching profile of a groove of the projectile, the cone tip being placed towards a rear section of the projectile, with the sub-band attached to the projectile by a cylindrical skirt.

The skirt will be able to have on its internal surface means to allow its friction-type connection with the sub-band.

The skirt will also be able to have an internal circular collar for the sub-band sectors to fit in.

According to an embodiment, the band will be able to have a layer of a sealing material placed at the rear of the sub-band or the internal collar of the skirt.

The skirt will be able to have a length between 50% and 80% of the caliber.

According to a characteristic, each sub-band sector will be able to have at the level of each of its lateral edges at least one indentation aimed at having a tight fit with one corresponding indentation of a neighboring sector so as to form a sealing deflecting plate for the propellant gases.

A flexible sealing material should advantageously be placed in the (deflecting) plates and at the level of a rear section of the sub-band.

According to a specific embodiment, the sealing band will be able to be of sub-caliber at least at the level of a front section.

The object of the invention is also a sub-caliber projectile equipped with such a band, the projectile comprising a tractor type sabot and with barrel guiding characteristics as well as improved sealing properties.

Thus the arrow projectile according to the invention comprises a sub-caliber core held by a sabot with a caliber made of at least two segments, this projectile has a band comprising a sub-band and it is characterized in that the sabot has a pusher plate located axially before the transversal plane passing through the gravity center of the complete projectile, the pusher plate containing at least one groove for the sub-band to fit in.

The deflecting plates separating the various sub-band sectors should advantageously be staggered with the parting lines separating the segments of the sabot.

Each segment of the sabot will be able to have a rear caliber guiding support.

Each segment of the sabot will be able to have a reinforcing rib extending longitudinally to the back of the pusher plate.

The rib will be able to be in contact with the skirt of the band. The skirt of the band will be able to then offer longitudinal internal grooves for the ribs to fit in.

The skirt of the band should advantageously be over-caliber at the level of a rear section.

The object of the invention is finally an ammunition associated with such a projectile.

This ammunition comprises a casing enclosing a propellant charge and including a projectile, the ammunition is characterized in that the skirt of the band is attached to a fastening ring fixed at the casing.

Part of the propellant charge will then be able to be placed in the skirt of the band.

BRIEF DESCRIPTION OF THE DRAWINGS

The invention will become more apparent from reading the following description of the various embodiments, with reference to the appended drawings in which.

DETAILED DESCRIPTION OF PREFERRED EMBODIMENTS

Figure 1A:
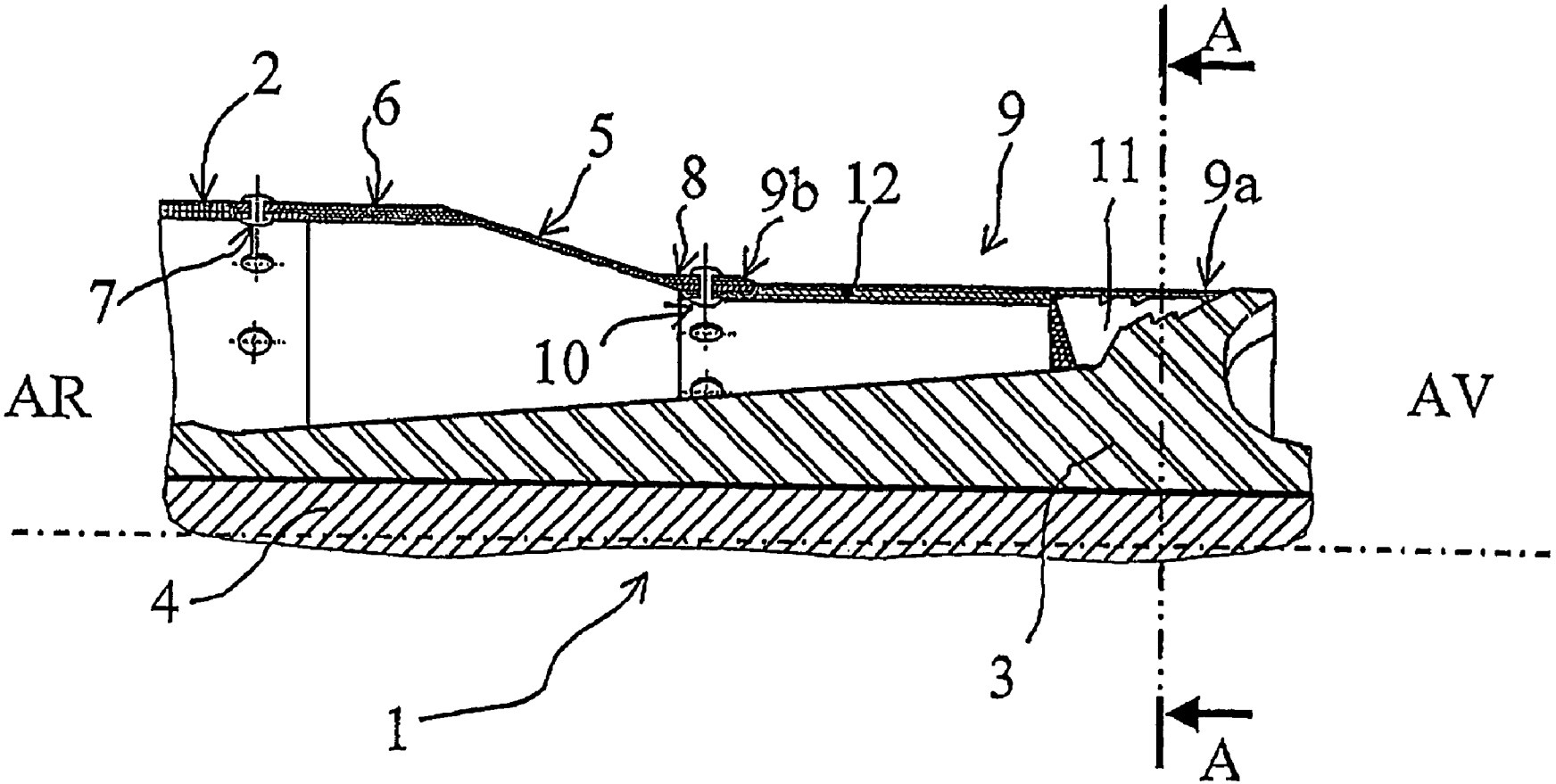
FIG. 1*a* shows a partial longitudinal cross-sectional view of a projectile equipped with a band according to the invention.
Figure 1B:
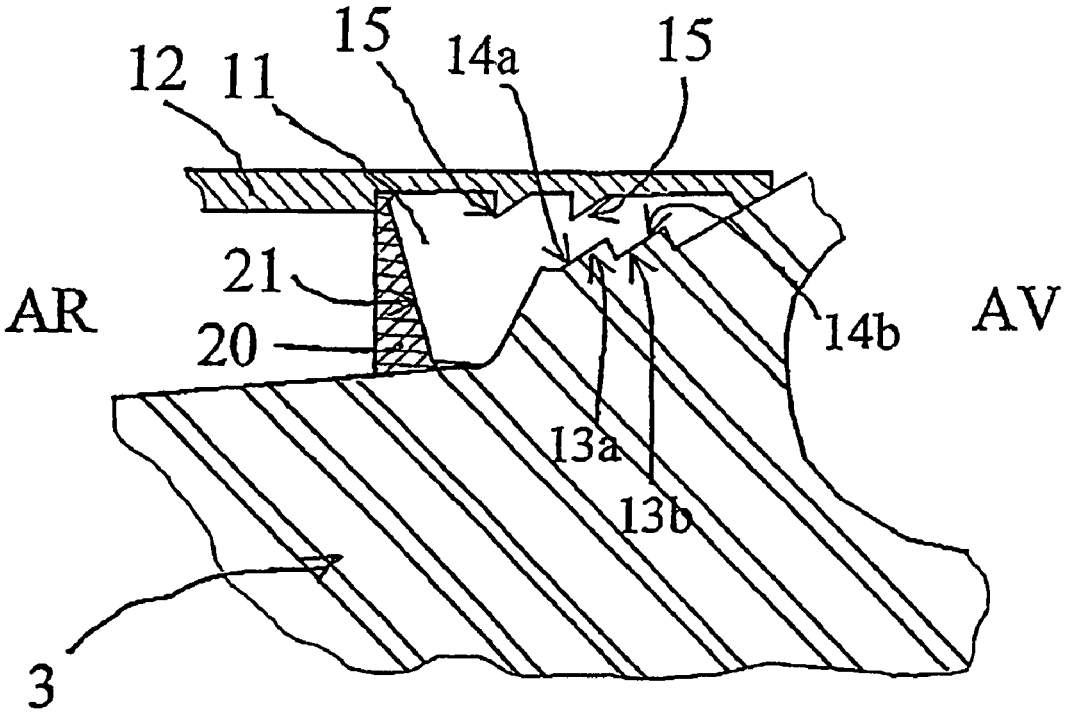
FIG. 1*b* is a magnified view of the sub-band and its fastening onto the sabot.

Referring to FIGS. 1*a* and 1*b*, a projectile 1, which is in this case a sub-caliber projectile stabilized by a tail (or arrow projectile), comprises a sabot 3 comprising at least two segments (in this case three segments) surrounding a core 4. The projectile 1 is attached to a combustible cartridge casing 2 via a fastening ring 5.

The fastening ring 5 comprises a rear tapered section 6, which is attached to the combustible cartridge casing 2 via an appropriate connecting means, for example rivets 7 fitted at regular angular intervals and/or by bonding.

The fastening ring 5 comprises a front section 8, which is attached to the projectile 1 at the level of the band 9 by using, for example rivets 10 fitted at regular angular intervals.

Figure 2:
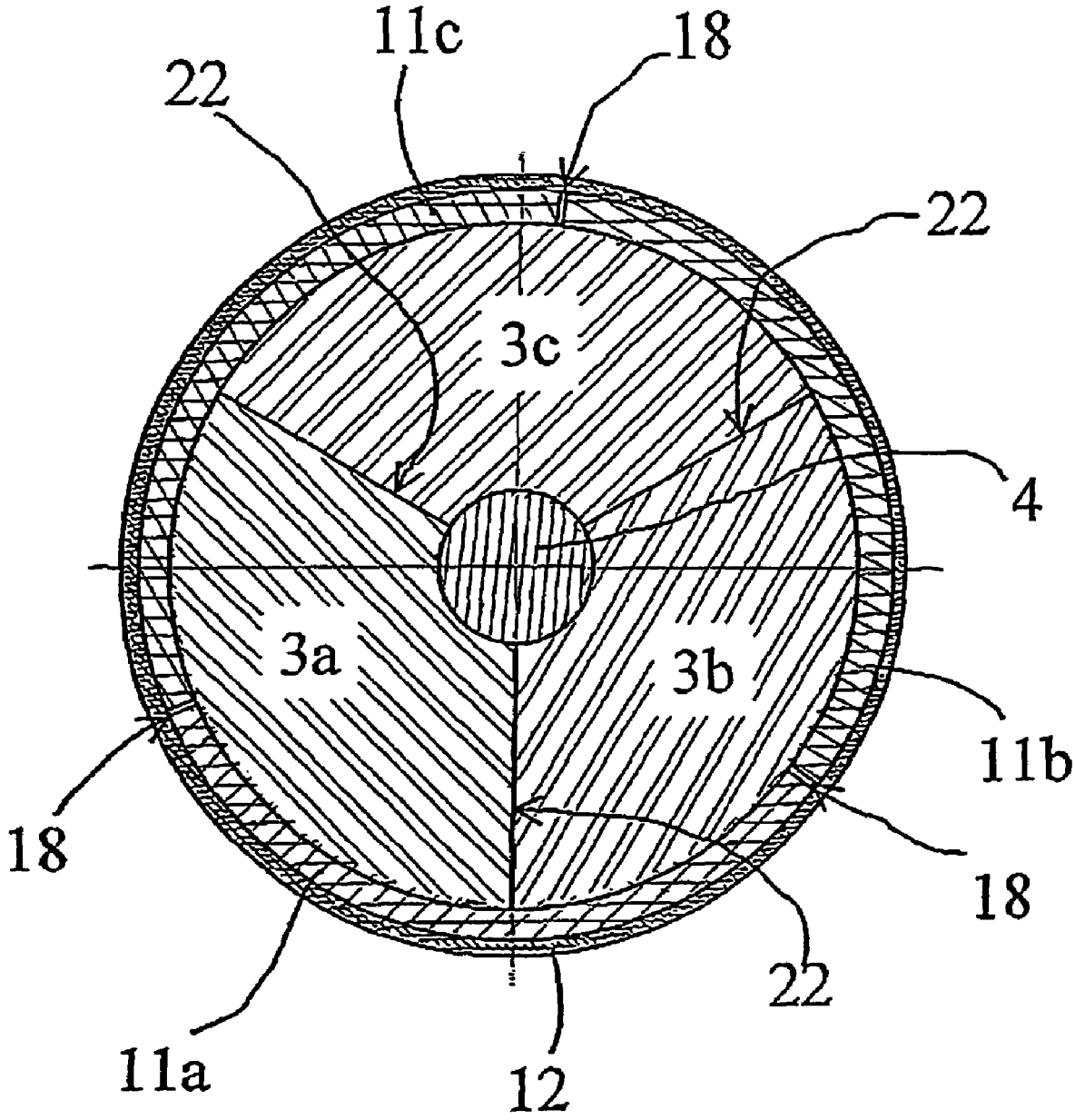
FIG. 2 is a transverse cross-sectional view of this projectile along line AA as indicated in FIG. 1.

In compliance with the invention, the sealing band 9 comprises a front sub-band 11 containing at least two sectors (in this case it has three sectors 11*a*, 11*b* and 11*c*—see FIG. 2), and which is fastened onto the projectile 1 with a cylindrical skirt 12.

The skirt has preferably a length between 50% and 80% of the caliber, namely 60 to 100 mm for a projectile of 120 mm caliber. Such a length is essentially twice that of classical bands.

The sub-band 11 includes two wedge-shaped profiles, 13*a*, 13*b*, in an axial cross-section, which profiles fit tightly with matching, complementary profiles 14*a*, 14*b* of an axial cross-section of a groove in the sabot 3.

The tip of the geometric cone delimiting each conical profile is placed at a rear section (AR) of the projectile. In this way, the diameter at the bottom of the groove in the sabot is increasing along profile 14*a* or 14*b* between the rear section AR and the front section AV of the projectile.

In this way, the gas pressure exerted on the sub-band 11 will push it with respect to the sabot 3, which will result, taking into account the conical shape of profiles 14*a*, 14*b*, in the sectors of the sub-band 11 being radially pulled apart.

The skirt 12 has on its internal surface a means for fastening to the sub-band. This means is here made of circular teeth 15, which have a tight fit with matching grooves arranged on the external cylindrical surface of the sub-band 11. Any other means of fastening could of course be considered, for example by threading.

Figure 3:
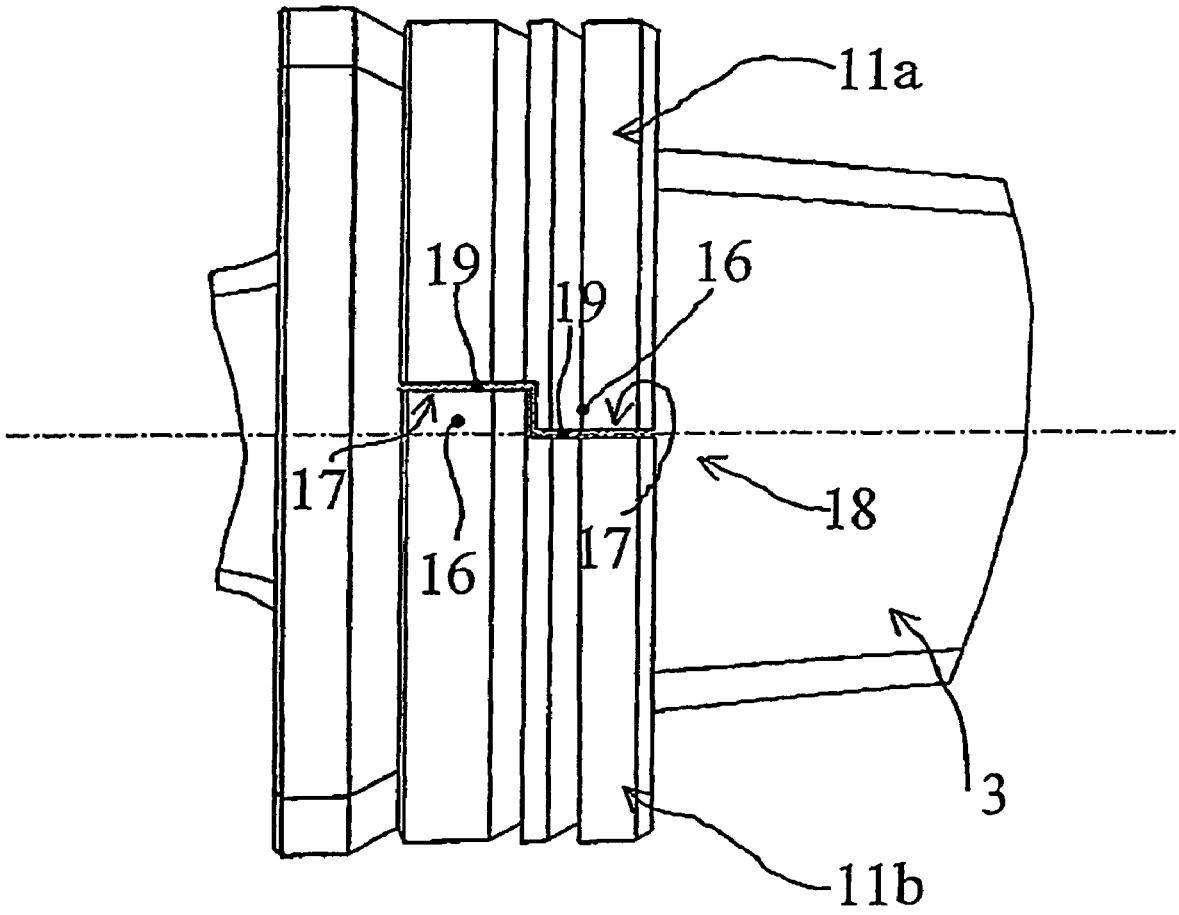
FIG. 3 is a detailed view of the band, where the skirt was removed, showing indentations at the level of the lateral edges of two sub-band sectors.

As especially clearly shown in FIG. 3, each sector 11*a*, 11*b*, 11*c* from the sub-band 11 has at the level of each one of its lateral edges at least an indentation 16 designed to fit tightly with a matching indentation 17 from a neighboring sector so as to build a deflecting plate 18 and provide a seal to propellant gases. A gap is provided at the level of each indentation between the two sectors, this gap being filled with a flexible sealing material 19, for example silicone.

The indentations shown here have the shape of strips having a tight fit with slots. It would be possible to design indentations of different shapes, for example in a toothed or curved form.

As shown in FIG. 2, the deflecting plates 18 separating the various sectors 11*a*, 11*b* and 11*c* from the sub-band 11 are placed in a staggered manner with the parting lines 22 separating segments 3*a*, 3*b* and 3*c* of the sabot 3. Such an arrangement has for an objective to improve the seal by avoiding weakness points, which could facilitate the passage of gases within the parting line.

In order to improve the sealing property of the sub-band 11, a flexible material 20, such as silicone resin, is also placed at the level of a pit 21 designed at the rear side of the sub-band 11 (see FIG. 1*b*).

The band assembly is made easier by the band subdivision in a sub-band 11 and a skirt 12. The large sectors of the sub-band are easily fitted without requiring deformation. The silicone joints are placed to ensure a temporary fastening between the sub-band and the projectile. The thin skirt 12 is then inserted by sliding around the projectile and makes a complete, tight fit with the various sections of the band. The skirt can be easily fitted without prior expansion. The assembly is therefore carried out completely cold, which is more economical and ensures improved reproducibility of the band's mechanical characteristics.

The operation of this band is as follows:

During firing of the projectile, gas pressure is exerted radially to the inside of the skirt 12 and, as a result, pushes the skirt against the internal surface of the weapon's barrel.

The rivets 10 break, and the projectile breaks away from the casing 2 and the fastening ring 5.

The gas pressure also pushes axially on the sub-band 11, which, thanks to the conical profiles 13 and 14, gets in turn radially pulled apart from the sabot 3 and is pushed onto the wall of the barrel. The division of the sub-band 11 in three sectors favors this pulling-apart.

The seal remains, however secured thanks to the plates 18 and the sealing material fillers 20 and 19, which allow for such a displacement of sectors 11*a*, 11*b*, and 11*c*.

The skirt 12 is sufficiently thin (on the order of one millimeter) and flexible to allow the sectors of the sub-band 11 to be pulled apart.

Upon exiting the weapon's barrel, the aerodynamic forces pull apart the segments 3*a*, 3*b* and 3*c* of the sabot, and the thin skirt 12 easily ruptures. The sub-band 11, which is subdivided in sectors, does not hinder the sabot/core separation.

In this way therefore, a perfect gas seal is obtained even in worn barrels. Thanks to the invention, the sealing property is improved on the one hand by the band being subdivided in three mobile sectors, and on the other by the skirt being fitted onto the internal wall of the barrel across an important area.

The skirt thus allows for the covering up of coating defects in the weapon's barrel (chromium-plating erosion and abrasion) and limits gas leaks at those points.

The band skirt also allows for protection of the wall of the barrel by avoiding impact from the propellant charge flames, which have the disadvantage of increasing chromium-plating erosion and abrasion.

As a variant, it would be possible to assemble in one piece the skirt 12 and the fastening part 5. An annular incipient crack would then have to be provided at the level of the changing diameter (at the level of rivets 10 in FIG. 1*a*) to ensure the reproducibility of the separation between the section of the skirt that provides the seal in the barrel and the tapered section providing the connection with the cartridge casing.

Figure 4:
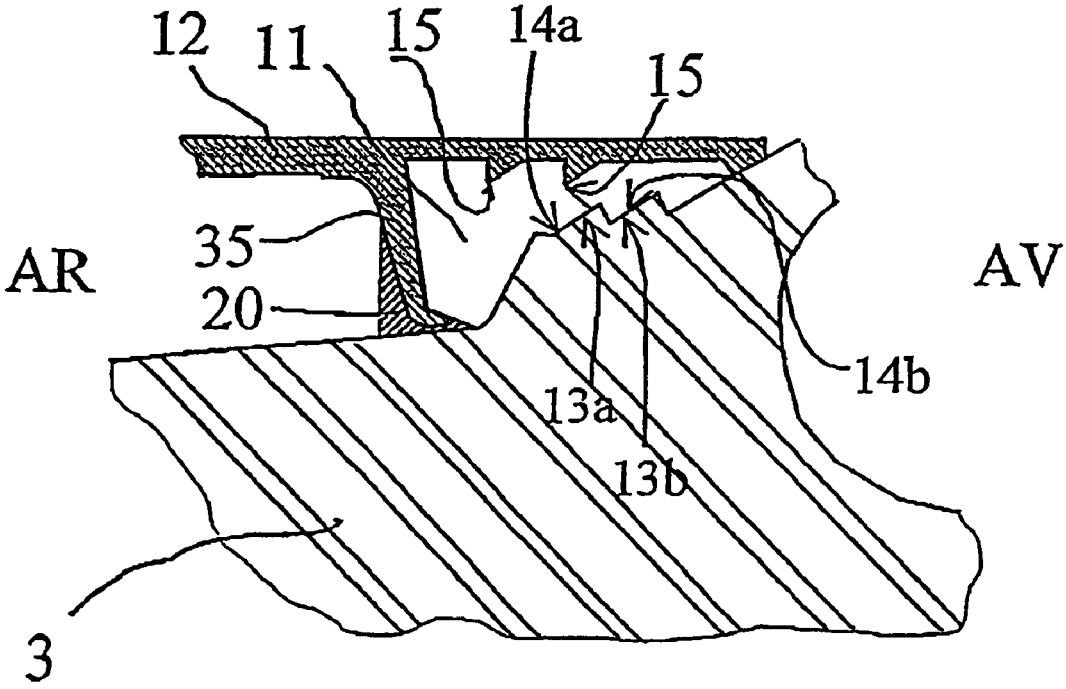
FIG. 4 shows a variant of the embodiment for the band.

FIG. 4 shows a variant embodiment of the band according to the invention.

According to this variant, the skirt 12 comprises an internal circular collar 35, which houses the sectors in the sub-band 11. The three sectors are thus held against the collar 35 and are also fixed by the circular teeth 15.

The assembly onto the sabot is carried out in the same way as for the previous embodiment.

A layer of a flexible material 20, such as silicone resin, is fitted after assembly at the rear section of the collar 35, and between the collar and the sabot 3. This material also fits into the sub-band 11 and allows for an improved seal against propellant gases.

The advantage of this variant is that it allows for an improved rear-section seal whilst holding the sub-band sectors into place.

The band, according to the invention, has been described here as adapted to a sub-caliber projectile. It is obviously possible to fit it onto a full caliber projectile.

The band, according to the invention, is however specifically adapted to equip an arrow projectile of tractor type sabot. Indeed, according to a variant of the invention, the band 9 can be of sub-calibre at the level of its front section 9*a*. Such a sub-calibre will be of the order of a few tens of mm, which is sufficient to facilitate the trouble-free insertion of the projectile inside the weapon's barrel.

The structural characteristics of the band according to the invention allow the sub-caliber to be recovered from the time of firing, providing thus a gas seal.

A slight over-caliber for the skirt 12 of the band will also be possible at the level of its rear section 9*b* (see FIG. 1*a*) . Such an arrangement allows for an improved low-pressure seal at the beginning of the powder combustion.

Figure 5:
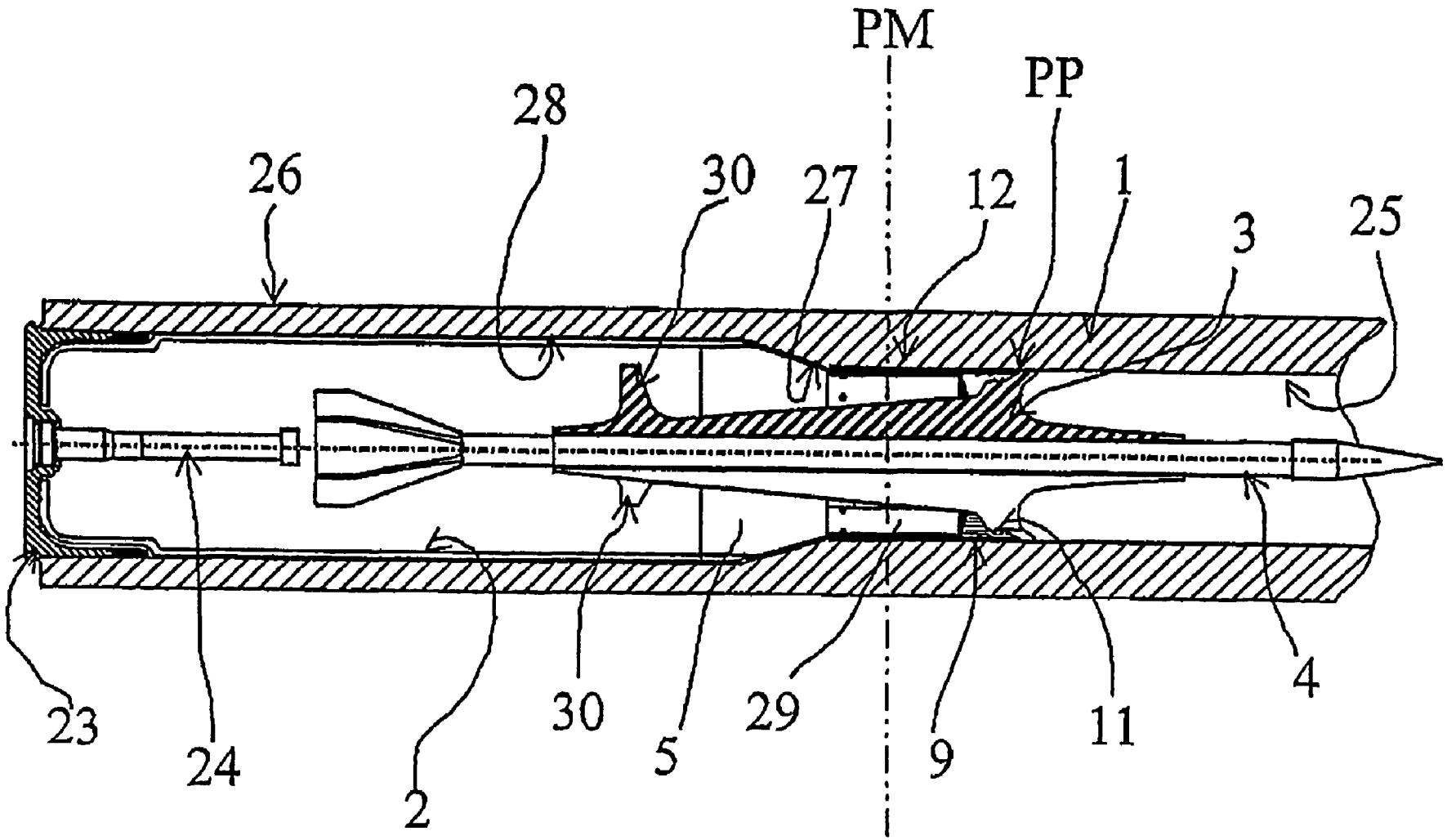
FIG. 5 shows a longitudinal cross-sectional view of a projectile and ammunition according to a first embodiment of the invention, the projectile being shown positioned in a weapon barrel.

FIG. 5 thus shows a projectile 1 and ammunition according to a first embodiment of the invention.

This ammunition comprises other than the projectile 1, a combustible casing 2 closed at the level of its rear section by an obtruding plug 23 carrying an igniter barrel 24. The casing encloses a propellant charge (not shown here).

In compliance with the invention, the projectile 1 comprises a sabot 3, with its pusher plate PP (part with a groove for the sub-band 11 to fit in) located axially in the front of a transverse median line PM that is the orthogonal plane to core 4 and across the gravity center for the complete projectile.

This sabot is of the tractor type. As shown in FIG. 5, the projectile 1 is inserted inside the barrel 25 of the weapon 26. The fastening ring 5 is held against the forcing cone 27, which links the barrel 25 to the chamber 28.

As previously explained, the setting up of the ammunition has been carried out without trouble thanks to the sub-caliber of the band 9. The gas seal will be ensured thanks to the band structure.

The internal volume 29 delimited by the skirt 12 contains a part of the propellant charge. The initial projectile velocity is increased in this way. The volume of additional powder therefore available is on the order of 0.5 to 0.8 liters for a 120 mm caliber. This results in an increase in the initial velocity on the order of 4 to 5%.

Such a performance increase is added to the performance resulting from a mass gain due to the tractor-type sabot technology. It can be confirmed by calculation that the optimum mass gain for a 120 mm caliber sabot is obtained by moving the pusher plate about 80 mm forward from its usual position at the level of the forcing cone. This results in a lightening of the sabot by 15 to 20% for a similar manufacturing cost.

According to the first embodiment of the projectile of the invention, each segment of the sabot 3 also comprises a caliber rear support 30. Such an arrangement allows for improved projectile guidance inside the weapon's barrel.

Guidance of the projectile 1 is thus ensured by the pusher plate alone for the first centimeters, then by the pusher plate and the supports 30 on the most part of the barrel.

Figure 6:
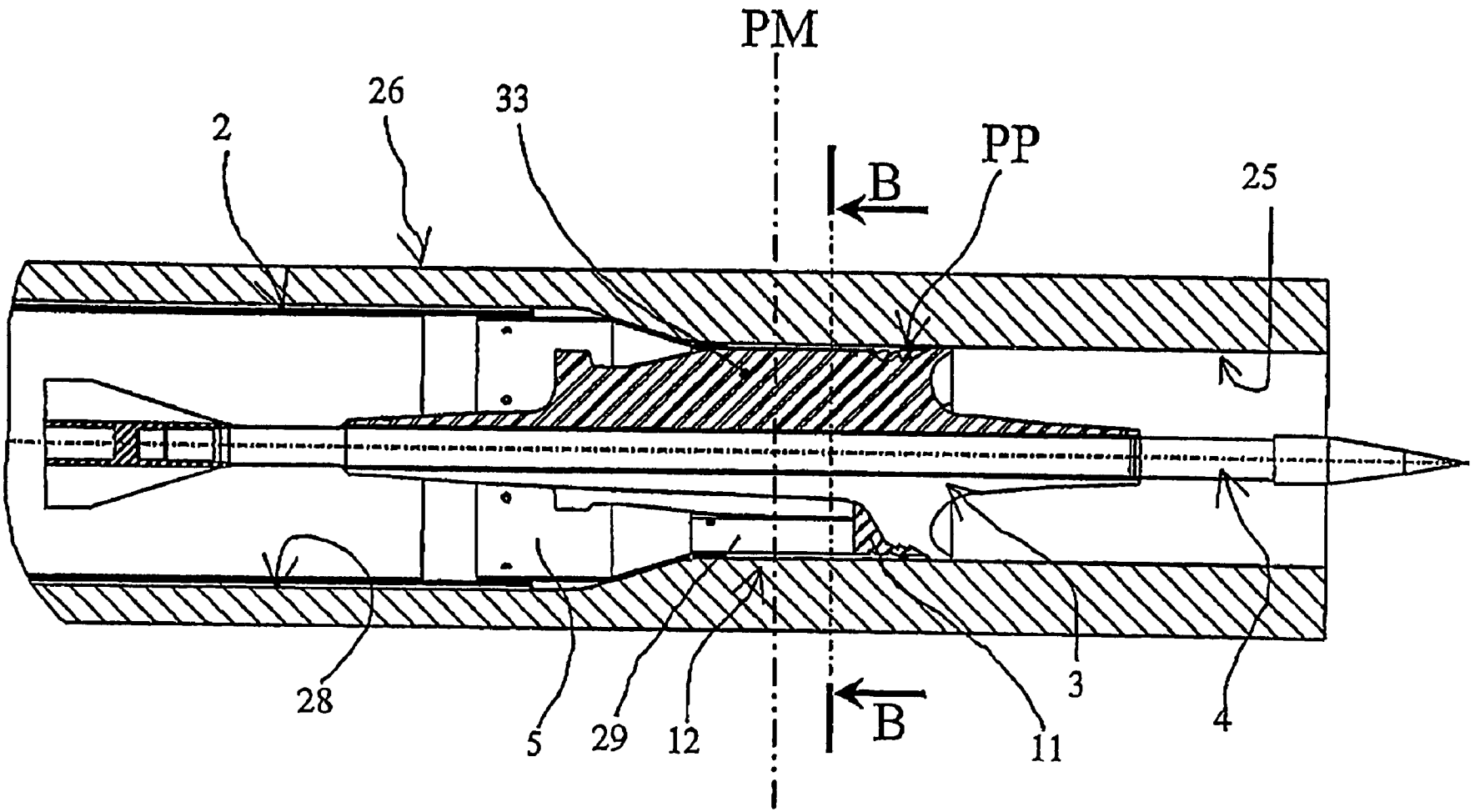
FIG. 6 shows a longitudinal cross-sectional view of a projectile and ammunition according to a second embodiment of the invention.
Figure 7:
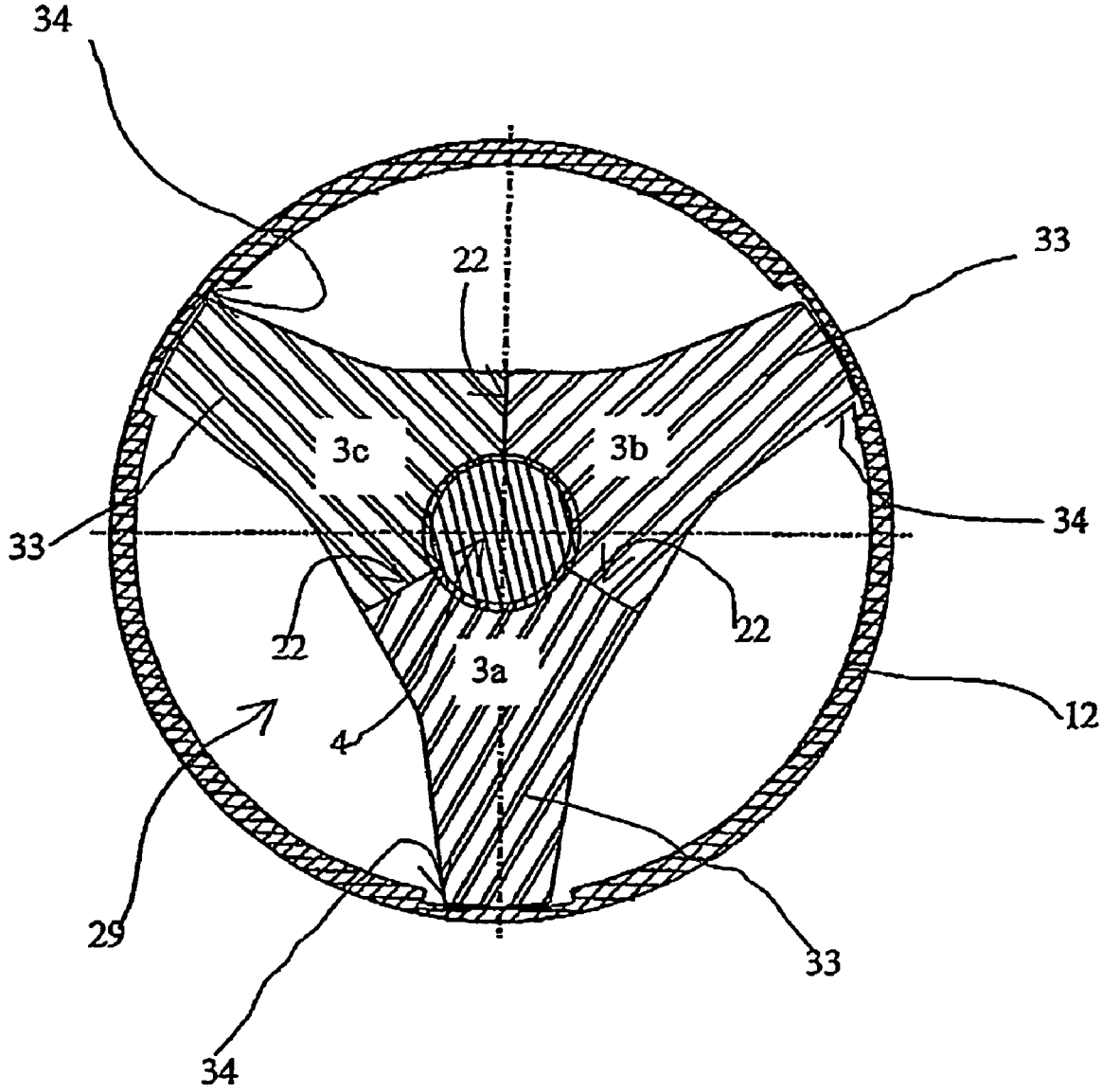
FIG. 7 is a transverse cross-sectional view of the projectile according to this second embodiment, the cross-section along line BB as indicated in FIG. 6.

FIGS. 6 and 7 show a projectile according to a second embodiment of the invention. This projectile differs from that of FIG. 5 in the sense that each segment 3*a*, 3*b*, 3*c* of the sabot 3 contains a reinforcing rib 33 extending longitudinally to the rear section of the pusher plate PP.

The ribs 33 allow for an increase in the transversal rigidity of the sabot 3.

As shown more specifically in FIG. 7, each rib 33 is in contact with the skirt 12 of the band. Thus, the ribs 33 allow for guiding the projectile in the weapon's barrel from the first firing instant.

The skirt 12 of the band shows internal longitudinal grooves 34 in which ribs 33 are located. Such an arrangement allows for the skirt 12 to be weakened, which in turn facilitates its rupture on exiting from the weapon's barrel. The assembly of the band is also made easier. Indeed, the ribs 33 provide guidance to the skirt 12, to easily fit over the sectors of the sub-band 11.

The invention claimed is:

1. A sealing band for a projectile, the band comprising:

a front sub-band comprising at least two axially longitudinal sections, the sub-band having at least one conical section, which in an axial cross-section includes a wedge-shaped profile, for tightly fitting with an adjacent bottom surface of an annular groove of such a projectile, said groove having a matching complementary wedge-shaped profile, and a cylindrical skirt removably attached to and fully covering the circumferential exterior surface of the sub-band, wherein the sub-band is not rotatable with respect to such projectile around a longitudinal axis of such projectile.

2. A sealing band according to claim 1, wherein the skirt has on its internal surface means for fastening to the sub-band.

3. Sealing band according to claim 2, characterised in that the skirt has an internal circular collar for the sub-band.

4. A sealing band according to claim 1, further comprising a layer of sealing material at the rear of the sub-band relative to a front end of such projectile.

5. A sealing band according to claim 1, wherein the skirt has a diameter, and a length between 50% and 80% of its diameter.

6. A sealing band according to claim 1, wherein each sub-band section comprises at least one indentation for connecting to a corresponding indentation of a neighbouring section for forming a sealing deflecting plate for propellant gases, such that at least part of each indentation passes through a single line parallel to a central axis of the sealing band.

7. A sealing band according to claim 6, further comprising a flexible sealing material between said sub-band sections and at a rear section of the sub-band.

8. The sealing band according to claim 6, wherein the sub-band sections are arc-shaped and the deflecting plate is circular.

9. A sealing band according to claim 1, wherein a rear section of the skirt of the band has a diameter greater than a calibre of a barrel for firing such projectile.

10. A sealing band according to claim 1, wherein a front section has a diameter smaller than a calibre of a barrel for firing such projectile.

11. A projectile comprising a sub-calibre core held by a full-calibre sabot comprising at least two segments, said projectile having a band according to claim 10 wherein the sabot further comprises a pusher plate located axially forward of a transversal plane passing through the center of gravity of the projectile, the pusher plate comprising at least one circumferential groove for receiving the sub-band.

12. A projectile according to claim 11, characterised in that each segment from the sabot has a rear calibre guiding support.

13. A projectile according to claim 11, characterised in that each segment of the sabot has a reinforcing rib extending longitudinally to the back of the pusher plate.

14. A projectile according to claim 13, characterised in that the rib is in contact with the skirt of the band.

15. A projectile according to claim 14, characterised in that the skirt of the band is provided with longitudinal internal grooves in which the ribs are fitted in.

16. Ammunition comprising a casing enclosing a propellant charge and a projectile according to claim 10, wherein the cylindrical skirt is attached to a fastening ring fixed at the casing.

17. Ammunition according to claim 16, characterised in that part of the propellant charge is placed in the skirt of the band.

18. The sealing band according to claim 1, wherein the at least two sections of the sub-band are arc-shaped.

* * * * *